US007857058B2

(12) United States Patent
Tulloch et al.

(10) Patent No.: US 7,857,058 B2
(45) Date of Patent: Dec. 28, 2010

(54) DOWNHOLE SWIVEL JOINT ASSEMBLY AND METHOD OF USING SAID SWIVEL JOINT ASSEMBLY

(75) Inventors: Rory McCrae Tulloch, Aberdeen (GB); Bruce McGarian, Aberdeen (GB)

(73) Assignee: Smith International, Inc., Houston, TX (US)

( * ) Notice: Subject to any disclaimer, the term of this patent is extended or adjusted under 35 U.S.C. 154(b) by 885 days.

(21) Appl. No.: 10/578,837

(22) PCT Filed: Nov. 23, 2004

(86) PCT No.: PCT/GB2004/004926

§ 371 (c)(1),
(2), (4) Date: May 23, 2007

(87) PCT Pub. No.: WO2005/052314

PCT Pub. Date: Jun. 9, 2005

(65) Prior Publication Data

US 2007/0246217 A1 Oct. 25, 2007

(30) Foreign Application Priority Data

Nov. 24, 2003 (GB) ..... 0327308.3

(51) Int. Cl.
*E21B 37/00* (2006.01)

(52) U.S. Cl. ..... 166/311; 166/173

(58) Field of Classification Search ..... 166/311, 166/242.7, 173

See application file for complete search history.

(56) References Cited

U.S. PATENT DOCUMENTS 3,690,122 A * 9/1972 Kisling et al. ..... 464/20
4,632,193 A 12/1986 Geczy
4,986,690 A * 1/1991 Cooksey ..... 403/319
5,139,090 A * 8/1992 Land ..... 166/369
5,697,768 A * 12/1997 Mills ..... 417/365
6,082,457 A * 7/2000 Best et al. ..... 166/301
6,241,032 B1 * 6/2001 Falgout, Sr. ..... 175/318
6,244,345 B1 6/2001 Helms
6,516,878 B1 * 2/2003 McGarian et al. ..... 166/242.7
7,011,162 B2 3/2006 Maguire
7,178,611 B2 * 2/2007 Zupanick ..... 175/75

(Continued)

FOREIGN PATENT DOCUMENTS

WO 9829637 7/1998

*Primary Examiner*—Daniel P Stephenson
(74) *Attorney, Agent, or Firm*—Dykema Gossett PLLC

(57) ABSTRACT

A downhole swivel joint assembly comprising an upper component and a lower component. The components may assume either of two stable positions relative to each other, namely an unactivated configuration in which the components are rotationally fast with each other by virtue of the inter-engagement of splines of the lower component with splines of the upper component and an activated configuration in which the respective splines are disengaged so that the upper and lower components can rotate relative to each other. In the activated configuration the upper component is supported relative to the lower component on a ball bearing pack. Movement of the components between the activated and unactivated configurations is controlled by a resiliently deformable latch member which is C-shaped in transverse cross-section. The latch member has an internal profile which co-operates with an external profile provided on the upper component mandrel to allow the upper and lower components to snap between the activated and unactivated configurations.

49 Claims, 7 Drawing Sheets

U.S. PATENT DOCUMENTS 7,281,584 B2 * 10/2007 McGarian et al. ..... 166/323
7,506,704 B2 * 3/2009 McGarian et al. ..... 175/321
2004/0045704 A1 * 3/2004 Bowles ..... 166/242.7
2008/0236841 A1 * 10/2008 Howlett et al. ..... 166/381

* cited by examiner

DOWNHOLE SWIVEL JOINT ASSEMBLY AND METHOD OF USING SAID SWIVEL JOINT ASSEMBLY

BACKGROUND OF THE INVENTION

1. Field of the invention

The present invention relates to a downhole swivel joint assembly and to a method of using said swivel joint assembly and furthermore to a wellbore clean-up assembly comprising said downhole swivel joint assembly and to a method of using said clean-up assembly.

2. The prior art

It is known in the gas and oil drilling industries to use a swivel joint assembly in wellbore clean-up operations to allow an uphole section of drill string to be rotated whilst a connected downhole section of string remains stationary. In these prior art swivel joint assemblies, a shear ring/pin arrangement is provided for allowing release of the assembly from an unactivated configuration, in which the uphole and downhole sections are locked to one another, and an activated configuration, in which the components are permitted to rotate relative to one another. It will be understood however that, once the shear ring/pin has sheared so as to allow movement from the unactivated configuration to the activated configuration, the assembly cannot then be retained in the unactivated configuration with the same effectiveness. The prior art swivel joint assemblies are arranged so that, when they are tripped uphole after having been activated, they will return to the unactivated configuration. However, with the primary means for retaining the assembly in the unactivated configuration no longer in place, subsequent movement of the assembly in a downhole direction and in a high wellbore drag environment (as encountered in high angle and horizontal wellbores) will frequently result in the assembly undesirably moving to the activated configuration. This is due to wellbore drag resisting movement of the assembly in a similar way to a landing profile provided within a wellbore for the purpose of activating an assembly. With the assembly arranged in an activated configuration as it is being run downhole, it is not possible for the downhole section to be rotated and this can be a disadvantage in certain operations. Furthermore, the prior art swivel joint assemblies used in clean-up operations incorporate vent apertures which are opened in moving from the unactivated configuration to the activated configuration and then allow cleaning fluid to be ejected from the interior of the assembly onto the wellbore casing to be cleaned. However, the vent apertures cannot be opened independently of the uncoupling of the uphole and downhole sections of the swivel joint assembly. This can be restrictive in certain clean-up operations. Prior art swivel joint assemblies also have poor rotational speed and load bearing performance which the applicant believes is due to their use of thrust plates as a bearing mechanism.

It is an object of the present invention to provide an improved downhole swivel joint assembly and wellbore clean-up assembly.

It is also an object of the present invention to provide an improved method of cleaning a wellbore.

SUMMARY OF THE INVENTION

A first aspect of the present invention provides a downhole swivel joint assembly comprising first and second components movable relative to one another in an axial direction along a longitudinal axis of the assembly, said components being movable relative to one another in said axial direction between an unactivated configuration, in which relative rotational movement between the first and second components is prevented, and an activated configuration, in which said rotational movement is permitted; wherein the assembly further comprises means for resisting movement of said components from the unactivated configuration to the activated configuration, said means comprising a resiliently deformable member arranged so as to be resiliently deformed when said components are moved from the unactivated configuration to the activated configuration.

Thus, in moving from the unactivated configuration to the activated configuration, the resisting means must be resiliently deformed and, since said resisting means is resilient to said deformation, it will be understood that said means is elastically deformed and will therefore apply a force which tends to resist the movement of said components. It will be understood that the resisting means may simply be a gripping member which relies on friction forces to resist movement. In this arrangement, when in the unactivated configuration, the resisting means may be resiliently deformed so as to apply a gripping force to one of said components and, by virtue of friction forces, provide resistance to movement.

In an alternative arrangement, said resiliently deformable member may comprise a first cam surface and may be retained in a fixed axial position relative to one of said first and second components, the other one of said components being provided with a second cam surface for co-operating with the first cam surface and radially camming said member into a resiliently deformed position when moving from the unactivated configuration.

Preferably, said resiliently deformable member comprises a third cam surface, said other one of said components being provided with a fourth cam surface for co-operating with the third cam surface and radially camming said member into a resiliently deformed position when moving from the activated configuration. It is also desirable for said resiliently deformable member to comprise a cylindrical wall having a slot extending through the full thickness of the wall and along the full length of the cylindrical wall. The cylindrical wall may also be located about one of said first and second components.

Furthermore, the first component is ideally provided with means for connecting the assembly to further downhole equipment located, in use, above the assembly; and wherein the second component is provided with means for connecting the assembly to yet further downhole equipment located, in use, below the assembly.

The second component, or equipment connected thereto, may be provided with an arm member extending outwardly for engaging, in use, with an uphole facing shoulder within a wellbore. The uphole facing shoulder may be the top of a liner hanger.

A bearing comprising rolling elements is ideally provided between the first and second components so as to assist in relative rotation between said components when said components are in the activated configuration. The bearing may comprise a plurality of races. Furthermore, the bearing may be located so as to be spaced from one of said components when said components are in the activated position. Said spaced component is ideally provided with means for engaging, when said components are in the activated configuration, co-operating means provided on the bearing so as to prevent relative rotation between the engaged parts of said component and bearing.

It will be understood that the resiliently deformable member allows said components of the swivel joint assembly to be repeatedly moved back and forth between the unactivated and activated configurations without loss of effectiveness at retaining the swivel joint assembly in the unactivated configuration. A swivel joint assembly according to the present invention may therefore be returned to the unactivated configuration and pulled uphole, and then subsequently tripped back downhole in a high drag environment without a likelihood of the assembly becoming activated.

A second aspect of the present invention provides a wellbore clean-up assembly comprising a downhole swivel joint assembly as referred to above and further comprising a fluid circulating assembly, the fluid circulating assembly comprising a body incorporating a wall provided with at least one vent aperture extending therethrough; and a piston member slidably mounted in the body and slidable in the body in response to the application thereto of fluid pressure; wherein the piston member is slidable between a first position relative to the body, in which the or each vent aperture is closed, and a second position relative to the body, in which the or each vent aperture is open; the fluid circulating assembly further comprising constraining means adapted to prevent movement of the piston member from the first position to the second position; and overriding means for overriding the contraining means so as to permit movement of the piston member to the second position.

The piston may be biased to the first position by means of a spring. Furthermore, the piston member may incorporate a wall provided with at least one opening extending therethrough such that, in the second position the opening of the piston member and the body are in register, and in the first position the openings of the piston member and the body are out of register. Preferably, the constraining means may comprise a guide pin and a guide slot for receiving the guide pin. The guide slot may extend in a direction having one component parallel to the direction of axial movement of the piston member. The overriding means may comprise an extension of the guide slot. Also, the guide pin may be fixedly located relative to the body and the guide slot may be formed in the exterior surface of the piston member or the second piston member slidably mounted in the body.

A further aspect of the present invention provides a method of cleaning a wellbore, the method comprising the steps of making up downhole apparatus comprising the wellbore clean-up assembly as referred to above; running said assembly down a wellbore to be cleaned; landing the downhole swivel joint on a restriction within the wellbore; applying weight of the downhole apparatus to said restriction so as to move the downhole swivel joint from an unactivated configuration to an activated configuration; moving the piston member of the fluid circulating assembly from the first position to the second position; and ejecting fluid from the interior of the fluid circulating assembly through the or each vent aperture.

The method may further comprise the step of pumping cleaning fluid down the interior of the downhole apparatus and up the annulus between said apparatus and the wellbore prior to moving the piston member of the fluid circulating assembly.

In addition, the method may comprise the step of making up said downhole apparatus so that the fluid circulating assembly is located uphole of the downhole swivel joint assembly; and rotating the fluid circulating assembly within the wellbore once the swivel joint assembly has been activated. The step of rotating the fluid circulating assembly comprises the step of rotating a conveying string connected to the fluid circulating assembly. Ideally, the conveying string is rotated from an uphole end of the wellbore.

Embodiments of the present invention will now be described with reference to the accompanying drawings.

DETAILED DESCRIPTION OF THE PREFERRED EMBODIMENTS

Figure 1:
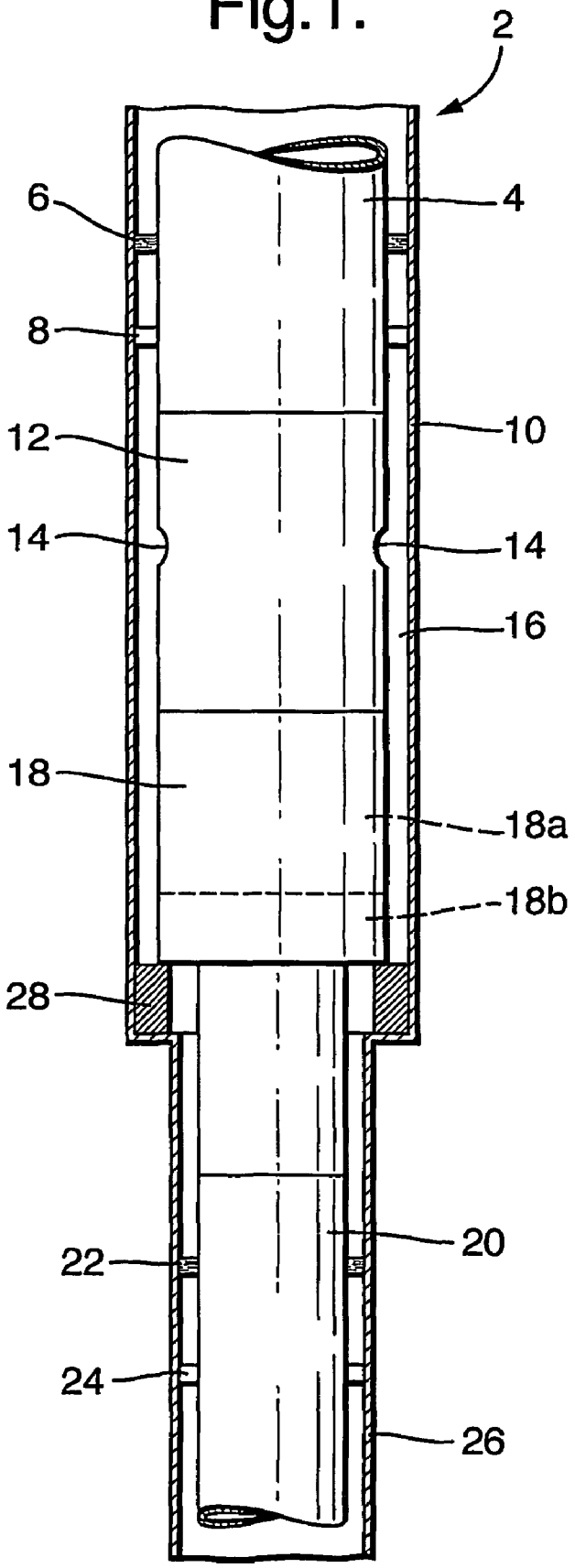
FIG. 1 is a schematic side view of a downhole assembly, according to the present invention, located within a borehole.

A downhole assembly 2 according to the present invention is schematically shown in FIG. 1 of the accompanying drawings. The assembly 2 functions to scrape and clean the casing of a wellbore during a downhole clean-up operation. To this end, the downhole assembly 2 comprises an upper brush/scraper assembly 4 comprising brushes 6 and scrapers 8 for engaging with a 9⅝ inch wellbore casing 10. Downhole of the upper brush/scraper assembly 4, the downhole assembly 2 comprises a multi-cycle circulating sub 12 having vent apertures 14 through which cleaning fluid may pass from a longitudinal bore (not shown in FIG. 1), running through the assembly 2, to the exterior of the downhole assembly 2. Thus, during use of the downhole assembly 2, the multi-cycle circulating sub 12 may, through an appropriate repeated application of fluid pressure, be cycled between open and closed configurations in which the vent apertures 14 are themselves open or closed. With the vent apertures 14 open (the open configuration), cleaning fluid may be ejected into the annulus 16 between the 9⅝ inch wellbore casing 10 and the downhole assembly 2. The presence of the cleaning fluid in the annulus 16 assists in the clean-up operation. Suitable multi-cycle circulating subs for use in the downhole assembly 2 is described in GB 2 314 106 and GB 2 377 234, the disclosures of which are incorporated herein by reference. However, for the reader's ease of reference, one of the circulating subs disclosed in GB 2 377 234 will now be described below.

Figure 11A:
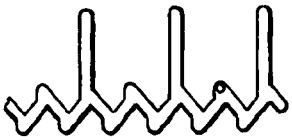
FIG. 11*a* is a plan view of the unwrapped profile of a control groove located relative to a control pin as shown in FIG. 11.
Figure 11:
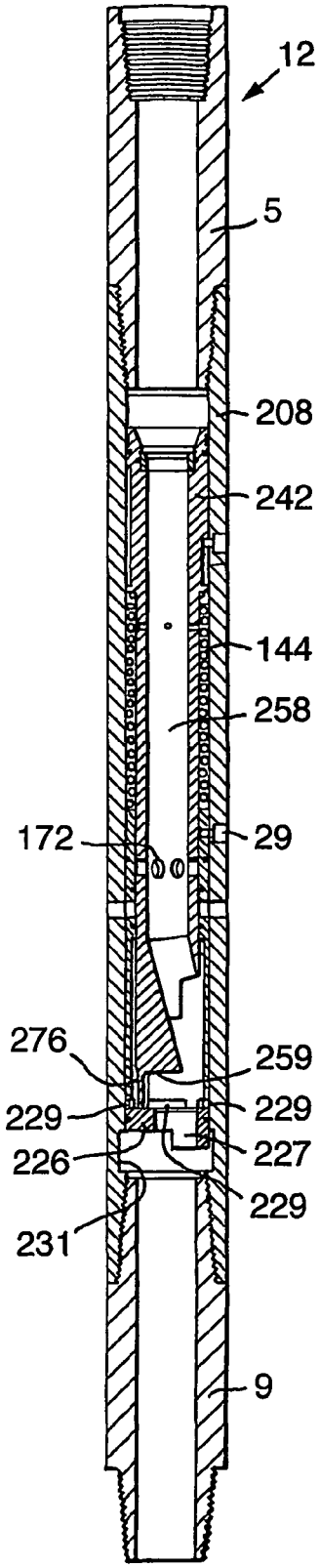
FIG. 11 is a cross-sectional side view of a circulating sub arranged in a first closed configuration with downhole movement of a sleeve restricted by a control groove and pin.
Figure 12:
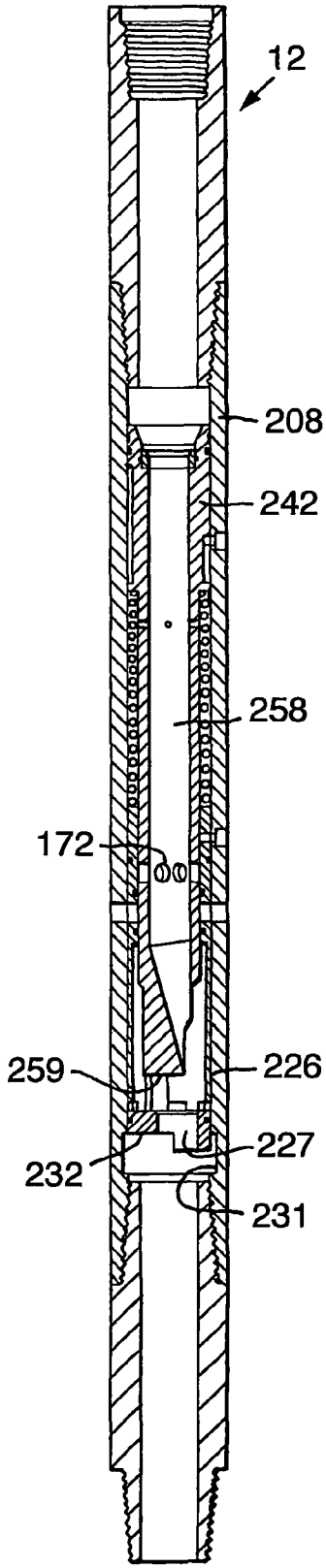
FIG. 12 is a cross-sectional side view of the circulating sub arranged in a second closed configuration with downhole movement of the sleeve restricted by the control groove and pin, and with the angular position of the sleeve differing to that shown in FIG. 11.
Figure 13:
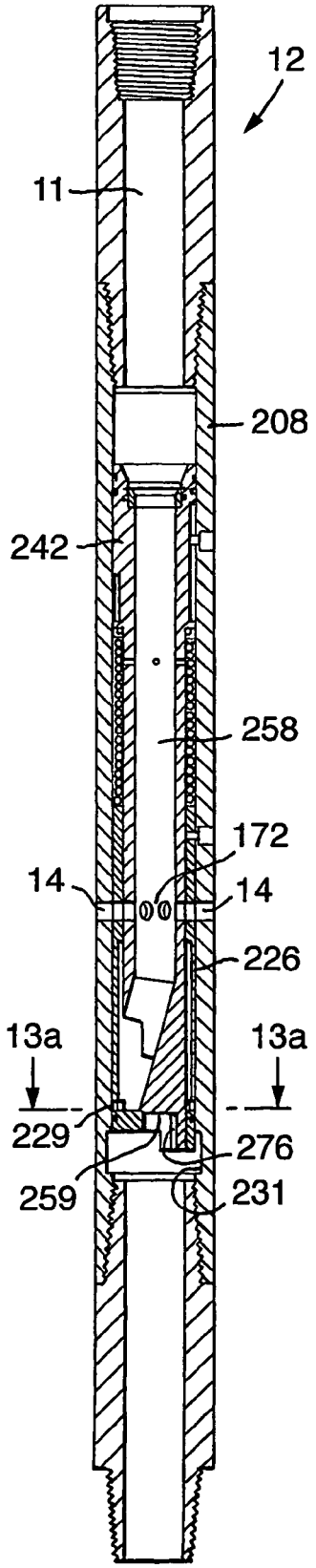
FIG. 13 is a cross-sectional side view of the circulating sub arranged in an open configuration.
Figure 14:
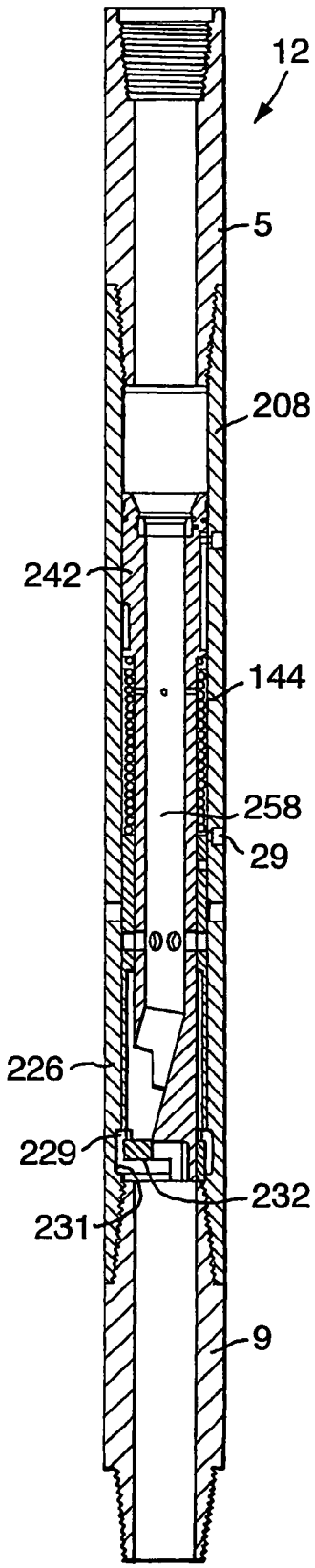
FIG. 14 is a cross-sectional side view of the circulating sub arranged in an emergency closed configuration.

A circulating sub 12 is shown in FIGS. 11 to 14 of the accompanying drawings. The sub 12 is a six-cycle circulating sub wherein the arrangement of the downhole portions of a second body member 208, sleeve 226 and piston 242 is such that, when the piston is in a closed position as shown in FIGS. 11 and 12 (or an emergency closed position as shown in FIG. 14), wellbore fluid may flow through the interior of the circulating sub 12; however when the piston 242 is in an open position as shown in FIG. 13, the bore 11 through the circulating sub 12 is closed and all wellbore fluid flowing downhole through the circulating sub 12 is directed into the annulus through vent apertures 14.

More specifically, the downhole portions of the sleeve 226 and piston 242 are arranged with an asymmetric configuration. The piston 242 defines a piston bore 258 having an upper portion coaxially arranged with the longitudinal axis of the circulating sub 12 and a lower portion located downhole of piston flow ports 172 which extends downhole at an angle relative to the longitudinal axis of the circulating sub 12. Accordingly, the downhole end of the piston bore 258 opens at a location offset from the longitudinal axis of the apparatus 12. This offset location provides a downhole facing piston shoulder 259 extending inwardly into the bore 11 of the circulating sub 12. A single piston element 276 extends downwardly from the shoulder 259. The downhole end of the sleeve 226 has a reduced diameter defining a restricted bore 227 within an axis offset relative to the longitudinal axis of the circulating sub 12. Uphole of the reduced diameter, the sleeve 226 is provided with four ports 229 which extend radially through the thickness of the sleeve 226.

Figure 13A:
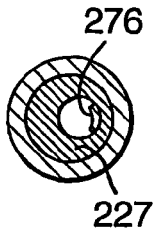
FIG. 13*a* is a cross-sectional view taken along line 13*a*-13*a* of FIG. 13.

When in the closed configuration as shown in FIGS. 11 and 12 wellbore fluid may flow through the circulating sub 12 via the piston bore 258, about the downwardly facing piston shoulder 259 and through the restricted sleeve bore 227. In FIG. 11, the circulating sub 12 is shown with the piston 242 displaced downhole against the bias of a compression spring 144 by means of an appropriate flow rate of wellbore fluid. Displacement of the piston 242 into an open position is prevented by abutment of the piston element 276 against a single sleeve element 232 defining the restricted bore 227. The circulating sub 12 is shown in FIG. 12 cycled to a further closed configuration with the piston 242 having been rotated within a second body member 208. Again, movement of the piston 242 into the open position is prevented by abutment of the piston element 276 against the sleeve element 232. However, with the circulating sub 12 cycled to the configuration shown in FIGS. 13 and 13*a*, it will be seen that the piston 242 has rotated sufficiently for the piston element 276 to align with the restricted bore 227 (acting as a sleeve slot) allowing the piston 242 to move further downhole relative to the sleeve 226. In so doing, the piston flow ports 172 align with the vent apertures 14 (allowing flow to the annulus) and the downwardly facing piston shoulder 259 closes the restricted sleeve bore 227 (preventing fluid flow within the bore 11 downhole past the second body member 208). Fluid flow through the four ports 229 is not possible in the open and closed piston positions of FIGS. 11, 12, 13 and 13*a* due to the sealing of these ports by means of the second body member 208.

The circulating sub 12 may be moved to an emergency closed position in the event that the piston 242 becomes jammed and the biasing force of the compression spring 44 is insufficient to return the piston 242 to its original uphole position in abutment with a first body member 5. The emergency closed configuration is achieved by increasing the flow of fluid through the bore 11. The flow rate is increased until the downhole force applied to the piston 242 is sufficient to release the piston 242 and shear a shear pin 29 holding the sleeve 226 relative to the sub body. The piston 242 and sleeve 226 are then moved downhole. Downhole movement of the piston 242 and sleeve 226 is limited by abutment of the sleeve 226 with a third body member 9. Although the restricted sleeve bore 227 remains sealed by the downwardly facing piston shoulder 259, flow through the bore 11 into the third body member 9 is permitted by means of the ports 229 provided in the sleeve 226. Flow through the ports 229 is possible with the sleeve 226 abutting the third body member 9 by virtue of a circumferential recess 231 provided in the interior surface of the second body member 208 at a downhole portion thereof. More specifically, the recess 231 is located uphole of the third body member 10 and downhole of the four ports 229 when the sleeve 226 is located in a non-emergency position (ie when retained by the shear pin 29 as shown in FIGS. 11 to 13*a*). The circumferential recess 231 has sufficient downhole length for wellbore fluid to flow through the sleeve ports 229, around and beneath the sleeve element 232, and into the third body member 9.

The downhole assembly 2 further comprises a swivel joint assembly 18 located downhole of the multi-cycle circulating sub 12. The purpose of the swivel joint assembly 18 is to allow selective relative rotation between components of the assembly 2 located uphole and downhole of the swivel joint assembly 18. The swivel joint assembly 18 is weight activated inasmuch as the swivel joint assembly 18 may be arranged to prevent relative rotation of the aforementioned component until the assembly 18 is received on a shoulder (for example, a tie-back receptacle, TBR) and at least some of the weight of the assembly 2 located above the swivel joint assembly 18 is applied. On the application of this weight, the swivel joint assembly 18 is activated so as to allow relative rotation between upper and lower components 18*a*,18*b* of the swivel joint assembly 18 and components of the downhole assembly 2 connected thereto. The detailed design of the swivel joint assembly 18 is discussed below with reference to FIGS. 2 to 10 of the accompanying drawings.

Having regard to FIG. 1, it will be seen that the downhole assembly 2 further comprises a lower brush/scraper assembly 20 located downhole of the swivel joint assembly 18. The lower brush/scraper assembly 20 comprises brushes 22 and scrapers 24 for engaging with a 7 inch wellbore casing 26.

In a downhole clean-up operation, the downhole assembly 2 is tripped in hole with the swivel joint assembly 18 arranged in an unactivated configuration wherein the upper and lower components 18*a*,18*b* of the swivel joint assembly 18 are rotatively locked to one another. Thus, rotation of the conveying string to which the upper brush/scraper assembly 4 is connected will result in a rotation of the lower brush/scraper assembly 20. Torque may therefore be transmitted through the downhole assembly 2 (including the swivel joint assembly 18) and allow both upper and lower brush/scraper assemblies 4, 20 to be used in cleaning wellbore casing. The provision of the weight activated swivel joint assembly 18 renders the downhole assembly 2 particularly suitable for use in a wellbore where an uphole facing shoulder is present. A typical scenario where this generally occurs is at a point of reduction in wellbore diameter. For example, in the schematic view of FIG. 1, a 9⅝ inch casing 10 reduces to a 7 inch casing 26. The upper and lower brush/scraper assemblies 4, 20 are appropriately sized so as to engage the 9⅝ inch and 7 inch casings 10, 26 respectively in the region of the reduction in bore diameter. With the lower brush/scraper assembly 20 located in the 7 inch casing 26, the conveying string (not shown) may be used to move the downhole assembly 2 axially in uphole and downhole directions within the wellbore. The conveying string may also be used to rotate the downhole assembly 2 (and, consequently, the upper and lower brush/scraper assemblies 4, 20) so as to clean both the 9⅝ inch and 7 inch casings 10, 26.

After the scraping and brushing operation has been completed, wellbore fluid is replaced with an appropriate cleaning fluid such as brine or sea water. Normally, the cleaning fluid is pumped downhole through an internal longitudinal bore running through the conveying string and downhole assembly 2. The cleaning fluid is ejected from the downhole end of the assembly 2 and passes uphole through the annulus between the assembly 2 and the 9⅝ inch and 7 inch casings 10, 26. This process is completed with the vent apertures 14 closed. However, once the cleaning fluid rises up the annulus beyond the vent apertures 14, the multi-cycle circulating sub 12 is cycled by an appropriate repeated variation in fluid/pressure flow within the downhole assembly 2 so as to open the vent apertures 14. The cleaning fluid passing downhole through the longitudinal bore of the downhole assembly 2 is then able to eject through the vent apertures 14 and forcefully engage the 9⅝ inch casing 10 so as to assist in the cleaning and general removal of debris from the surface of the casing 10. Furthermore, it will be understood that the fluid ejected through the vent apertures 14 increases the general rate of fluid flow in the annulus and thereby assists the cleaning operation.

In a variation of this process, a reverse circulation takes place before the conventional pumping from the surface down the string so as to effect fluid replacement. The multi-cycle circulating sub 12 will remain closed during the reverse circulation.

Typically, the cleaning fluid will be pumped downhole behind pill and spacer fluid. The pill fluid is a high density drilling mud (considerably more dense than the wellbore drilling mud) and is pumped downhole ahead of the spacer fluid to drive mud/debris in the wellbore annulus uphole and to stop debris settling out. The spacer fluid follows behind the pill fluid and ahead of the cleaning fluid. For an oil base wellbore mud fluid, the spacer fluid will be pure base oil.

In order to further improve the cleaning process (by swirling annulus mud more vigorously so as to prevent solids from settling out), the circulating sub 12 can be configured with the vent apertures open so that some of the fluid flowing downhole through the apparatus is directed through said apertures into the 9⅝ inch casing annulus. If the design of the circulating sub permits, all fluid flow may be directed through the vent apertures. In either case, the brushes and scrapers in the 7 inch casing will then operate in a drier environment, which may not be desirable. However, this can be avoided by activating the swivel joint assembly 18 and, in so doing, uncoupling the lower brush/scraper assembly 20 from the remaining assembly and conveying string located uphole thereof. In order to activate the swivel joint assembly 18, the assembly 18 is lowered onto the uphole facing shoulder resulting from the transition from the 9⅝ inch casing 10 to the 7 inch casing 26. In practice, a tie-back receptacle 28 will generally be located in the 9⅝ inch casing 10 adjacent the reduction in borehole diameter and it is with this receptacle 28 that the swivel joint assembly 18 engages. Once engaged with the tie-back receptacle 28, further downhole movement of the lower component 18*b* of the swivel joint assembly 18 is prevented and the weight of the downhole assembly 2 and conveying string may be increasingly applied to the 7 inch wellbore casing. As will be appreciated from the subsequent detailed description, the swivel joint assembly 18 comprises a latch mechanism which operates to uncouple the upper and lower components 18*a*, 18*b* of the assembly 18 and thereby allow relative rotation of said components 18*a*,18*b* once a predetermined weight has been applied to the tie-back receptacle 28. This uncoupling is accompanied by a small downhole movement of the upper component 18*a* and the remainder of the assembly 2 and conveying string located thereabove. This small downhole axial movement is indicative to an operator at the surface that the swivel joint assembly 18 has been activated. More specifically, the weight of the lower component 18*b* and equipment connected downhole thereof will be supported in the 7 inch casing and come off at the surface. Thereafter, when additional load is applied (eg 30,000 to 60,000 lbs), the upper component 18*a* will move downhole accompanied by a corresponding movement at the surface indicating decoupling.

With the swivel joint assembly 18 activated, the upper brush/scraper assembly 4 may be more readily rotated at a greater speed than if the assembly below the swivel joint assembly 18 was also to be rotated. Indeed, the upper brush/scraper assembly 4 may typically be rotated at the maximum rotational speed (for example, 250 rpm) whilst the lower brush/scraper assembly 20 remains stationary. This high rotational speed of the upper brush/scraper assembly 4 results in greater turbulence within the annulus and allows solids in the annulus to be entrained more effectively in the uphole flow of annulus fluid. Cleaning efficiency within the 9⅝ inch casing 10 is thereby improved. Also, the use of a bearing assembly (see below) assists in the upper section being rotated at higher speeds than in prior art systems which have used thrust plate arrangements.

Figure 2:
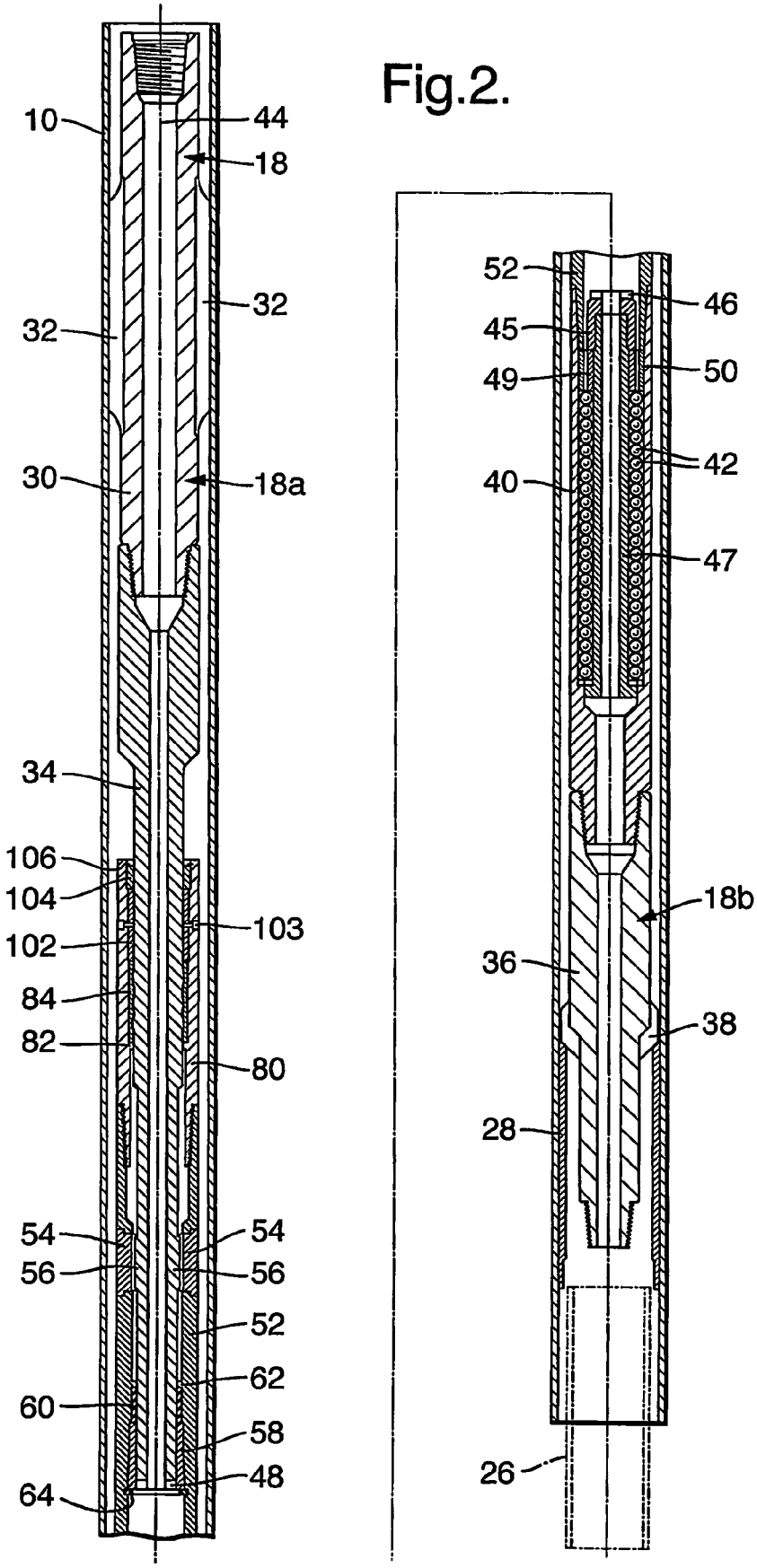
FIG. 2 is a detailed cross-sectional side view of a downhole assembly, according to the present invention, located downhole in an unactivated configuration.
Figure 3:
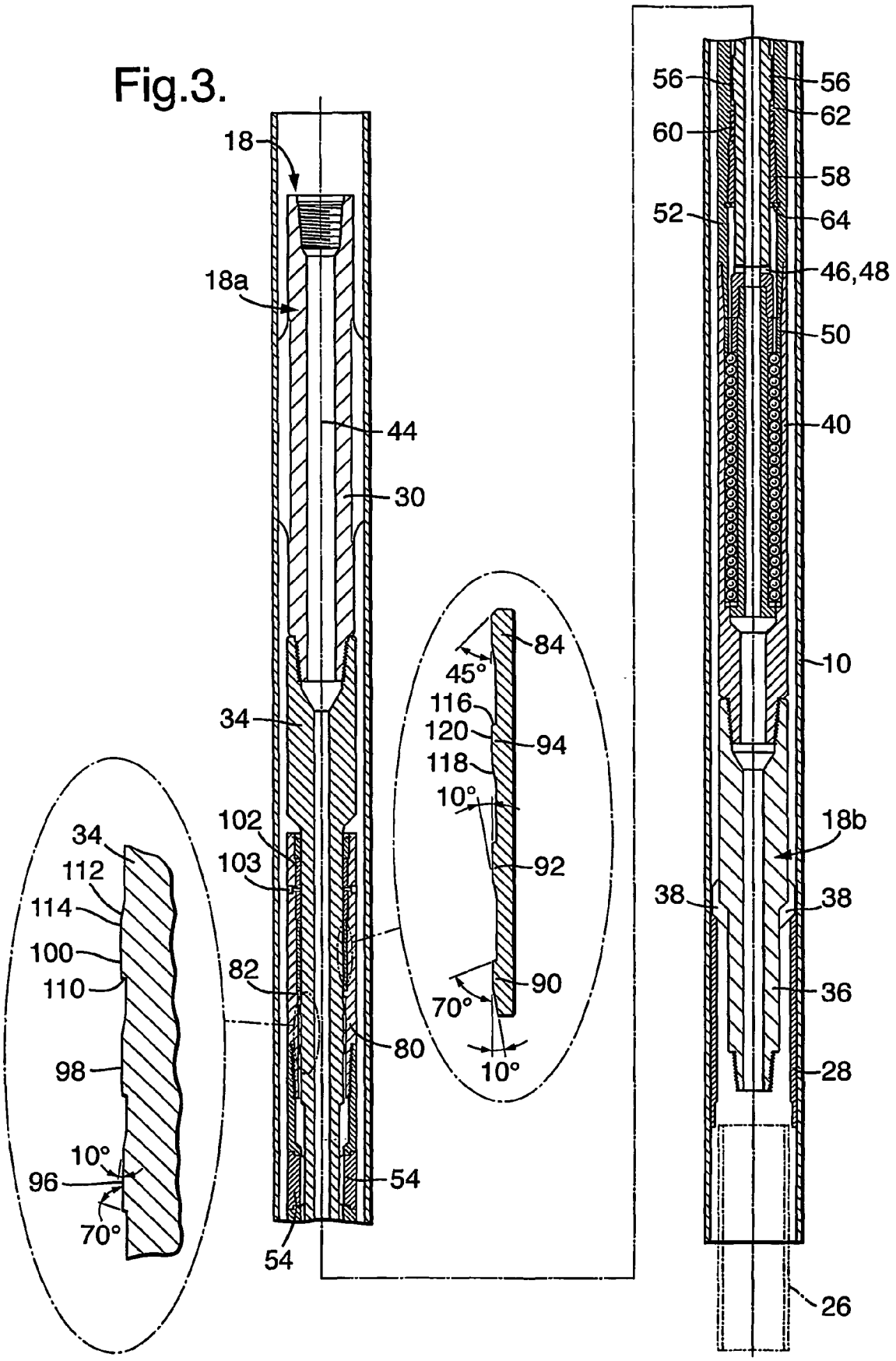
FIG. 3 is a detailed cross-sectional side view of a downhole assembly, according to the present invention, located downhole in an activated configuration.
Figure 4:
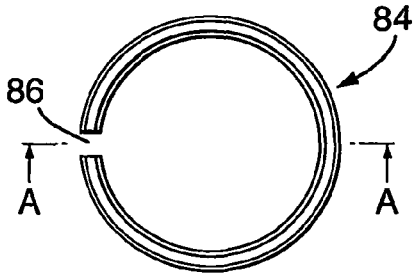
FIG. 4 is an end view of a C-ring latch member of the assembly shown in FIGS. 2 and 3.
Figure 5:
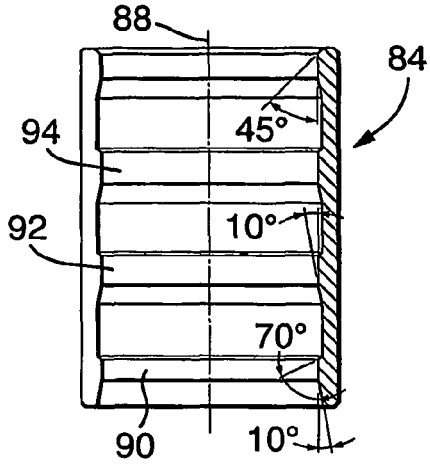
FIG. 5 is a cross-sectional side view of the C-ring member of FIG. 4 taken along line A-A of FIG. 4.
Figure 6:
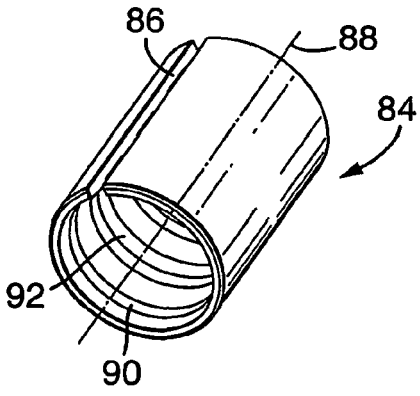
FIG. 6 is a perspective view of the C-ring member of FIGS. 4 and 5.

A more detailed view of the swivel joint assembly 18 is shown in FIGS. 2 and 3 of the accompanying drawings. In FIG. 2, the assembly 18 is shown in an unactivated configuration, whilst in FIG. 3 the swivel joint assembly 18 is shown in an activated configuration. First, with reference to FIG. 2, it will be seen that the upper component 18*a* of the swivel joint assembly 18 comprises a stabiliser 30 having a plurality of radially extending blades 32 for engaging the 9⅝ inch casing 10 and retaining the swivel joint assembly 18 concentrically located therewithin. The upper component 18*a* of assembly 18 also comprises a mandrel 34 connected to the downhole end of the stabiliser 30. The mandrel 34 is of an elongate cylindrical form and telescopically locates within the lower component 18*b* of the swivel joint assembly 18.

The lower component 18*b* of the swivel joint assembly 18 comprises a landing sub 36 with radially extending arm members 38 projecting from a substantially cylindrical body. The arm members 38 are circumferentially spaced about the body of the landing sub 36 so that, when the arm members 38 bear against the tie-back receptacle 28 during use, annulus fluid may flow uphole past the landing sub 36 through the spaces between the arm members 38.

The lower component 18*b* further comprises a bearing sub 40 connected to the uphole end of the landing sub 36. The bearing sub 40 houses a multi-race ball bearing pack 42. This ball bearing pack 42 is provided with upper and lower contact surfaces for each bearing race which are oriented at an angle of 45° to the longitudinal axis 44 of the swivel joint assembly 18. The arrangement is such that the ball bearing pack 42 is capable of withstanding uphole and downhole axial loads of 50,000 lbs. Alternative types and arrangements of bearing pack will be apparent to a skilled reader. The uphole end of the ball bearing pack 42 is provided with castellations 46 which, when the swivel joint assembly 18 is activated, engage with corresponding castellations 48 provided on the downhole end of the mandrel 34. It will be understood that, when the lower and upper castellations 46, 48 are engaged with one another, rotary motion of the mandrel 34 will be transmitted directly to the ball bearing pack 42. In this way, the mandrel 34 may be rotated whilst the weight of the upper component 18*a* and associated conveying string is at least partially applied to the lower component 18*b* of the swivel joint assembly 18.

The castellations 46 of the bearing pack 42 are provided on a shaft coupling 45 which is screw threadedly connected to the uphole end of a bearing shaft 47 running longitudinally through the inner races of the bearing sub 40. The shaft coupling 45 presses down on a ring member 49 which, in turn, presses down on the inner bearing races and retains them located in relation to the bearing shaft 47.

The ball bearing pack 42 is-retained in position within a bore of the bearing sub 40 by means of a ring member 50 which locates between and in abutment with an uphole end of the ball bearing pack 42 and a downhole end of a spline sub 52. The spline sub 52 is threadedly connected to the bearing sub 40 and this threaded connection allows the ring 50 to be placed under compressive load and thereby ensure the ball bearing pack 42 is firmly retained in the desired axial position within the bore of the bearing sub 40. The ring member 50 is selected to have a length suitable for ensuring the ball bearing pack 42 is pressed downhole.

The spline sub 52 is a generally elongate cylindrical member with a plurality of circumferentially spaced splines 54 projecting radially inwardly into a longitudinal bore of the spline sub 52 in which the mandrel 34 locates. The splines 54 are originally separate from the main body of the spline sub 52 and, during assembly of the swivel joint assembly 18, are located through apertures in the body of the spline sub 52 and welded in position. The arrangement is such that, when the swivel joint assembly 18 is in the unactivated condition as shown in FIG. 2, the splines 54 engage with corresponding splines 56 which extend radially outwardly from the mandrel 34. The upper and lower components 18*a*,18*b* of the swivel joint assembly 18 are thereby rotationally locked to one another. However, although the inter-engaging splines 54, 56 prevent relative rotation of the upper and lower components 18*a*,18*b* of the assembly 18, the splines 54, 56 nevertheless do not hinder relative axial movement of said components 18*a*, 18*b*.

In order to assist in axial and rotational movement between the mandrel 34 and the spline sub 52, a journal bearing 58 is located about the mandrel 34 downhole of the splines 54 of the spline sub 52. Furthermore, in order to prevent a leakage of fluid from within the swivel joint assembly 18 to the wellbore annulus, a seal set 60 is provided between the mandrel 34 and the spline sub 52. The seal set 60 is located about the mandrel 34 between and in engagement with the journal bearing 58 and a shoulder 62 inwardly projecting from the body of the spline sub 52 into the bore thereof. The seal 62 is preferably a static and rotational dual-directional chevron seal set. Whilst uphole movement of the journal bearing 58 and seal set 60 relative to the spline sub 52 is prevented by means of the shoulder 62, downhole movement of these components 58, 60 is prevented by virtue of the journal bearing 58 being screw threadedly connected to the spline sub 52 with a left-hand screw thread. The journal bearing 58 is prevented from becoming unscrewed by means of a circlip 64 located downhole of the seal set 60 in a circumferential groove provided in the bore of the spline sub 52.

Figure 7:
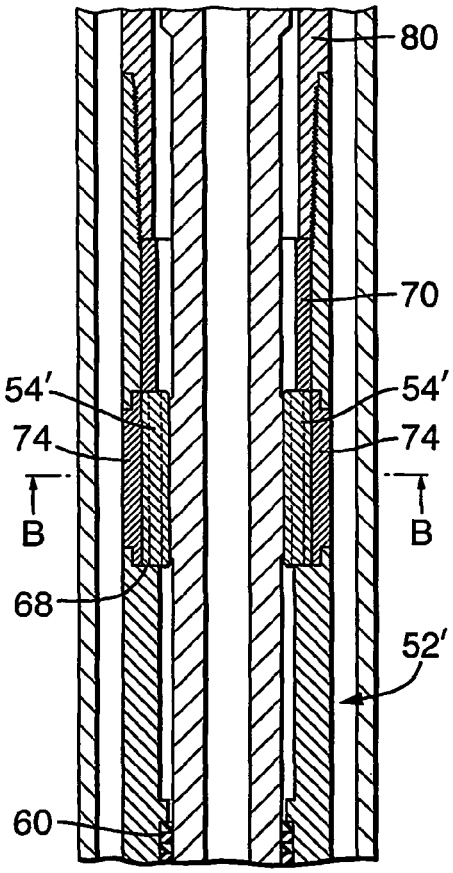
FIG. 7 is a partial view, in cross-section, of a modified version of the assembly shown in FIGS. 2 and 3.
Figure 8:
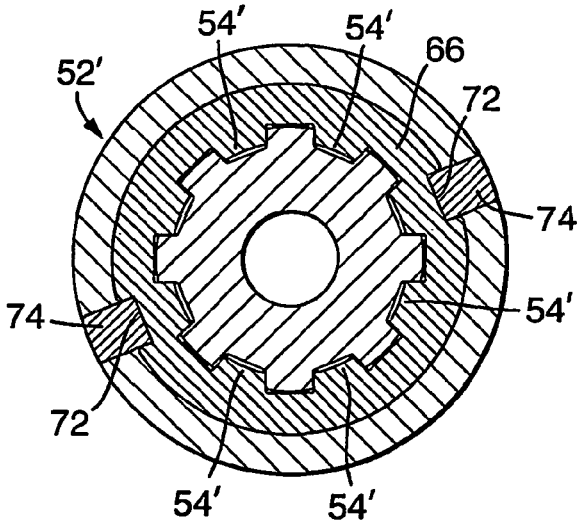
FIG. 8 is a cross-sectional view of the assembly of FIG. 7 taken along line B-B of FIG. 7.

In a preferred modified version of the spline sub 52, retention of the splines of the spline sub in the required position is achieved without the need for welding. Such a modified spline sub 52' is shown in FIGS. 7 and 8 of the accompanying drawings. The splines 54' of the modified spline sub 52' are provided integrally with a cylindrical ring member 66 (see FIG. 8) which locates between and in abutment with an uphole facing annular shoulder 68 defined in the bore of the spline sub 52' body and a retaining cylindrical ring 70. The ring 70 is itself prevented from moving uphole relative to the body of the spline sub 52' by virtue of its abutment with a latch sub 80 (described hereinafter with reference to FIGS. 2 and 3) screwthreadedly connected to the uphole end of the spline sub 52'. Thus, by means of this threaded connection, the cylindrical ring 70 is pressed onto the splined ring member 66 and thereby firmly retains said member 66 in axial position against the aforementioned uphole facing shoulder 68.

In order to prevent rotational movement of the ring member 66 relative to the body of the modified spline sub 52', the exterior surface of the ring member 66 is provided with two diametrically located straight slots 72 extending along the longitudinal length of the ring member 66. In the assembled spline sub 52', the slots 72 each receive a key 74 axially and rotationally fixed to the body of the spline sub 52'. The keys 74 thereby rotationally lock the ring member 66 to the body of the spline sub 52'. The keys 74 are themselves each located in an elongate slot provided in the body of the spline sub 52' and, in the assembled spline sub 52', are trapped between the body of the spline sub 52' and the ring member 66 and are thereby retained in position. No welding of the keys 74 or the ring member 66 is required.

Returning to the apparatus of FIGS. 2 and 3, the lower component 18*b* of the swivel joint assembly 18 further comprises a latch sub 80 threadedly connected at its downhole end to the uphole end of the spline sub 52. The latch sub 80 is of a generally cylindrical shape with an annular shoulder 82 projecting into a bore thereof and against which a C-ring latch member 84 abuts. As will be seen with particular reference to FIGS. 4 and 6 of the accompanying drawings, the C-ring member 84 has a cylindrical shape with a straight slot 86 extending through the full thickness of the cylindrical wall of the member 84 and along the full length of the member 84 in a direction parallel with the longitudinal axis 88 of the member 84. Furthermore, the internal surface of the C-ring latch member 84 is provided with three identical axially spaced circumferential ridges 90, 92, 94. The longitudinal axis 88 of the C-ring member 84 (and the longitudinal axis 44 of the assembly 18) is perpendicular to each of the planes in which the circumferential ridges 90, 92, 94 lie. In the assembled swivel joint assembly 18, the C-ring member 84 locates about the mandrel 34 and the ridges 90, 92, 94 co-operate with corresponding ridges 96, 98, 100 on the exterior surface of the mandrel 34. The mandrel ridges 96, 98, 100 are similar in shape to those provided on the C-ring member 84 (although oriented up-side-down relative to the C-ring ridges) and are arranged circumferentially on the exterior surface of the mandrel 34. An enlarged cross-sectional view of the mandrel ridges 96, 98, 100 is provided in FIG. 3 of the accompanying drawings. The specific geometry of the ridges provided on the C-ring member 84 and the mandrel 34 is explained in more detail hereinafter. However, it should be understood that the engagement of the C-ring ridges with the mandrel ridges is such that axial movement of the mandrel 34 relative to the latch sub 80 is resisted (but not prevented), with an axial telescoping of the mandrel 34 into the lower component 18*b* requires greater axial force than a subsequent axial telescoping of the mandrel 34 out of the lower component 18*b*.

The C-ring member 84 is retained freely floating about the mandrel 34 and adjacent the annular shoulder 82 by means of a split journal bushing 102 which is located uphole of the C-ring member 84. The bushing 102 is itself retained in position by means of a plurality of pins 103 extending radially inwardly from latch sub housing into apertures/recesses in the bushing 102 and furthermore by means of a retainer nut 104 engaging an internal screwthread provided in the bore of the latch sub 80 at the upper end thereof. The retainer nut 104 is prevented from becoming unscrewed from the latch sub bore by means of a circlip 106 located uphole of the retainer nut 104. The bushing 102 may be retained with a shoulder located in the bore of the latch sub housing downhole of the bushing 102 rather than (or as well as) with the plurality of pins 103. Thus, it will be understood that the arrangement is such that the C-ring member 84 is retained axially fixed relative to the bore of the latch sub 80. It should however also be understood that the external diameter of the C-ring member 84 is less than the diameter of the latch sub bore so that, as the ridges 90, 92, 94 of the C-ring member 84 move over the ridges 96, 98, 100 of the mandrel 34 during activation and deactivation of the swivel joint assembly 18, the C-ring member is permitted to resiliently expand in a radial direction. It will be appreciated that this radial expansion is facilitated by means of the slot 86 provided in the C-ring member 84 and by its floating mount arrangement within the latch sub housing.

The specific geometry of the ridges provided on the C-ring member 84 and the mandrel 34 will now be described. With reference to the mandrel 34, each of the mandrel ridges 96, 98, 100 have flat surfaces 110, 112 sloping (ie angled to, rather than parallel with, the longitudinal axis 44 of the assembly 18) and extending radially outwardly so as to intersect with a flat cylindrical plateau surface 114. The enlarged view of the mandrel 34 shown in FIG. 3 clearly illustrates the configuration of the mandrel ridges 96, 98, 100 and it will be seen that the flat plateau surface 114 is parallel with the longitudinal axis 44 of the assembly 18 (rather than being angled thereto). The downhole facing sloping surface 110 is arranged so as to slope more steeply relative to the longitudinal axis 44 than the uphole facing sloping surface 112. In the embodiment of FIG. 3, the downhole facing flat surface 110 forms an acute angle with the longitudinal axis 44 of 70° whereas the uphole facing sloping surface 112 forms an acute angle with the longitudinal axis 44 of 10°. However, in alternative embodiments, it will be understood that these angles for the downhole and uphole facing sloping surfaces can be different (for example, 80° and 15° respectively).

The ridges 90, 92, 94 provided on the C-ring member 84 each have an uphole facing sloping surface 116 forming the same acute angle with the longitudinal axis 44 as the downhole facing surfaces 110 of the mandrel 34. Similarly, the ridges 90, 92, 94 of the C-ring member 84 each comprise a downhole facing sloping surface 118 formed at the same acute angle to the longitudinal axis 44 as the uphole facing surfaces 112 of the mandrel 34. Thus, the uphole sloping surfaces 116 of the C-ring ridges slope more steeply relative to the longitudinal axis 88 than the downhole facing surfaces 118. The ridges 90, 92, 94 of the C-ring member 84 further comprise a cylindrical flat plateau surface 120 intersected by the uphole and downhole sloping surfaces 116, 118. However, in the case of both the mandrel and the C-ring ridges, the provision of a flat plateau surface 114, 120 is optional. When the flat plateau surfaces 114, 120 are not provided, the uphole and downhole sloping surfaces intersect directly with one another. In this arrangement, said sloping surfaces are axially arranged so as to be closer to one another than when a flat plateau surface is present. The sloping surfaces do not then radially project any further than those ridges provided with flat plateau surfaces.

It will also be understood that the spacing between the ridges of either one of the mandrel and the C-ring provides valleys large enough for the ridges on the other of the mandrel and C-ring to locate therein.

With the swivel joint assembly 18 arranged in the unactivated configuration of FIG. 2, each mandrel ridge 96, 98, 100 is located uphole of a ridge 90, 92, 94 of the C-ring member 84. When the arm members 38 of the landing sub 36 engage a TBR 28, the swivel joint assembly 18 may be weight activated by allowing weight of the assembly to press down on the TBR 28. In so doing, the downhole facing sloping surfaces 110 of the mandrel ridges 96, 98, 100 abut the uphole facing sloping surfaces 116 of the C-ring ridges 90, 92, 94. Due to the relatively steep sloping angle of the abutting surfaces 110, 116 it will be understood that the mandrel 34 must be pressed downhole with a relatively large force before the C-ring will be resiliently expanded in a radial direction by virtue of said sloping surfaces 110, 116 sliding over one another. However, provided sufficient force is applied, each mandrel ridge may be moved downhole passed the ridge of the C-ring member 84 with which it was previously engaged. If the downhole force on the mandrel 34 is maintained, then all three of the mandrel ridges 96, 98, 100 may be moved downhole of the C-ring ridges 90, 92, 94 as shown in FIG. 3. In so doing, the castellations 46, 48 engage with one another and the swivel joint assembly 18 is placed in the activated configuration.

It will be appreciated that the castellations 46, 48 will engage one another with considerable axial force due to the high forces required to press the mandrel ridges passed the C-ring ridges. The ball bearing pack 42 is therefore provided to withstand this high dynamic shock load.

In order to deactivate the swivel joint assembly 18, the mandrel 34 is pulled uphole with the result that the less steep sloping surfaces 112, 118 of the mandrel 34 and C-ring 84 engage and move passed each other. Again, the movement of the ridges passed one another is facilitated by a resilient radial expansion of the C-ring member 84. Furthermore, due to the small acute angle made by said sloping surfaces 112, 118 with the longitudinal axis 44, the force required to move the mandrel 34 in an uphole direction passed the C-ring member 84 is significantly less than that required to move the mandrel 34 downhole passed the C-ring member 84. Accordingly, the swivel joint assembly 18 may be readily de-activated, but is unlikely to be activated inadvertently.

It will be understood that the activation characteristics of the swivel joint assembly 18 may be modified by varying the number and/or geometry of the mandrel and/or C-ring ridges. For example, the force required for activation may be increased by increasing the steepness of the relatively steep sloping surfaces 110, 116 of either of the mandrel and C-ring ridges.

Figure 9:
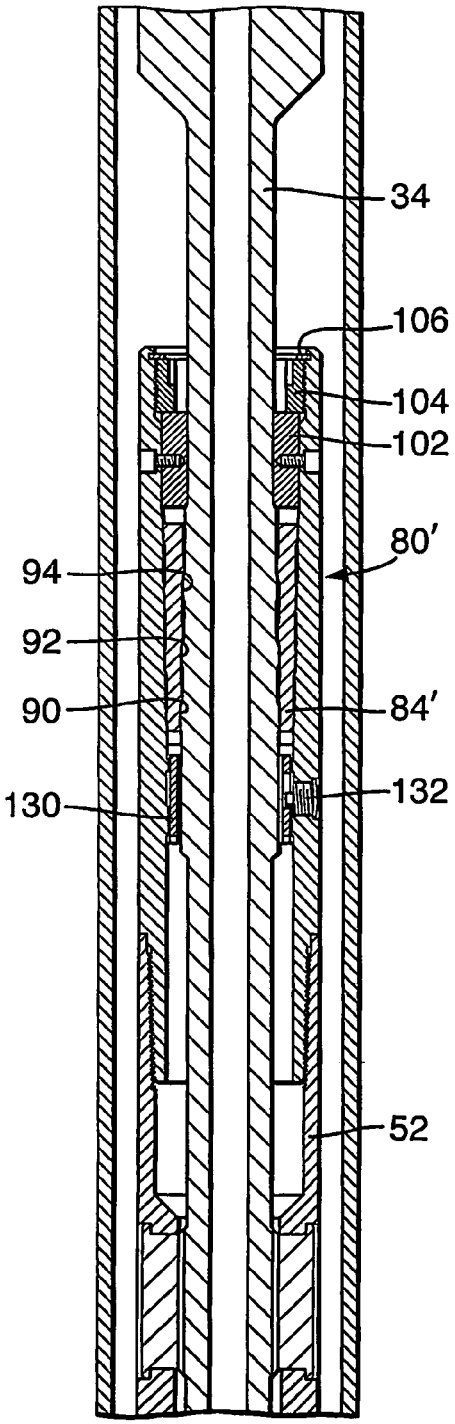
FIG. 9 is an enlarged detailed cross-sectional side view of the downhole assembly shown in FIGS. 2 and 3 modified so as to incorporate an alternative latch mechanism, wherein the assembly is located downhole in an unactivated configuration.
Figure 10:
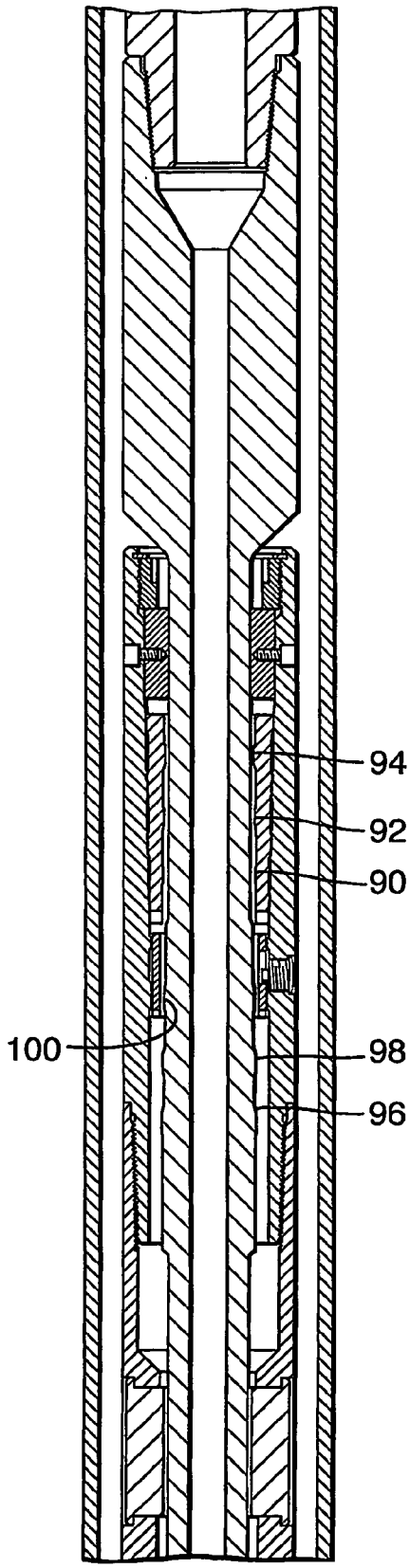
FIG. 10 is an enlarged detailed cross-sectional side view of the downhole assembly shown in FIG. 9, wherein the assembly is located downhole in an activated configuration.

The latching characteristics of the latch sub 80 may be altered through use of a modified latch sub 80' in which an adjustable latch mechanism is provided (see FIGS. 9 and 10 of the accompanying drawings). This type of latch mechanism is known in the prior art and is used in BOWEN surface jars. However, such a mechanism has not previously been used as described hereinafter. In the modified latch sub 80', the C-ring latch member 84 is replaced by a latch member 84' having a cylindrical wall which tapers to a reduced thickness in a downhole direction. The latch member 84' is machined as a double-ended collett with each successive cut extending from a different end of the cylindrical wall. Each cut extends along the length of the cylindrical wall from one end of the wall to just short of the opposite end of the wall. Also, in the region of the latch sub 80' where the latch member 84' is located, the wall of the latch sub housing increases in thickness in a downhole direction. The arrangement is such that the annular space between the mandrel 34 and the latch sub housing tapers to a reduced radial dimension in the axial downhole direction. This tapering corresponds to the tapering of the latch member 84' such that the latch member 84' may be located in a downhole position in which most of the length of the internal surface thereof is substantially in contact with the mandrel 34 and substantially the entire length of the exterior surface thereof is in contact with the latch sub housing. In this position of the latch member 84', it will be understood that there is limited room for radial expansion of the latch member 84' and, accordingly, a greater axial force must be applied to the mandrel 34 in order to press the ridges 96, 98, 100 provided thereon past the ridges 90, 92, 94 provided on the latch member 84'.

The aforementioned ridges of the modified latch sub 80' are of the similar size, shape and spacing as those of the latch sub 80 shown in FIGS. 2 and 3. However, the axial force required to pass the mandrel 34 downhole (and thereby activate the swivel joint assembly) may be reduced by retaining the latch member 84' in a more uphole position within the latch sub housing. In this way, the latch member 84' is located in a region where the radial dimension of the annulus between the latch sub housing and the mandrel 34 is increased. The latch member 84' is therefore provided with increased room for radial expansion and, accordingly, may be radially expanded more readily upon the application of downhole axial force to the mandrel 34. The axial position of the latch member 84' may be altered through use of a control ring 130 located downhole of the latch member 84'. The axial position of the control ring 130 is maintained by means of a pin 132 radially extending from the housing of the latch sub 80' into a control groove provided in the ring 130. The axial position of the latch member 84' may be adjusted by selecting an appropriately sized ring 130 on assembly of the latch sub 80' or by rotating the ring 130 so as to locate the pin 132 in a different part of the ring control groove and thereby displacing the ring 130 uphole or downhole.

The present invention is not limited to the specific embodiments described above. Alternative arrangements will be apparent to a reader skilled in the art. For example, the invention is not limited to the two sizes of wellbore casing referred to above. The embodiments described above can be readily modified for use with casing diameters different to those specifically mentioned herein.

The invention claimed is:

1. A downhole swivel joint assembly comprising first and second components movable relative to one another in an axial direction along a longitudinal axis of the assembly, said components being movable relative to one another in said axial direction between a mechanically stable unactivated configuration, in which relative rotational movement between the first and second components is prevented, and a mechanically stable activated configuration, in which said rotational movement is permitted; wherein the assembly further comprises means for resisting movement of said components from the unactivated configuration to the activated configuration and also from the activated configuration to the unactivated configuration, said means comprising a resiliently deformable member arranged so as to be resiliently deformed when said components are moved from the mechanically stable unactivated configuration to the mechanically stable activated configuration.

2. The downhole swivel joint assembly according to claim 1, wherein the resiliently deformable member is arranged to be resiliently deformed when the components are moved from the activated configuration to the unactivated configuration.

3. The downhole swivel joint assembly according to claim 1, wherein the force needed to move the components from the unactivated configuration to the activated configuration is greater than the force necessary to move the components from the activated configuration to the unactivated configuration.

4. The downhole swivel joint assembly as claimed in claim 1, wherein said resiliently deformable member comprises a first cam surface and is retained in a fixed axial position relative to one of said first and second components, the other one of said components being provided with a second cam surface for co-operating with the first cam surface and radially camming said member in to a resiliently deformed position when moving from the unactivated configuration.

5. The downhole swivel joint assembly as claimed in claim 4, wherein said resiliently deformable member comprises a third cam surface, said other one of said components being provided with a fourth cam surface for co-operating with the third cam surface and radially camming said member in to a resiliently deformed position when moving from the activated configuration.

6. The downhole swivel joint assembly as claimed in claim 1, wherein said resiliently deformable member comprises a cylindrical wall having a slot extending through the full thickness of the wall and along the full length of the cylindrical wall.

7. The downhole swivel joint assembly as claimed in claim 6, wherein the cylindrical wall is located about one of said first and second components.

8. The downhole swivel joint assembly as claimed in claim 1, wherein the first component is provided with means for connecting the assembly to further downhole equipment located, in use, above the assembly; and wherein the second component is provided with means for connecting the assembly to yet further downhole equipment located, in use, below the assembly.

9. The downhole swivel joint assembly as claimed in claim 8, wherein the second component, or equipment connected thereto, is provided with an arm member extending outwardly for engaging, in use, with an uphole facing shoulder within a wellbore.

10. The downhole swivel joint assembly as claimed in claim 1, wherein a bearing comprising rolling elements is provided between the first and second components so as to assist in relative rotation between said components when said components are in the activated configuration.

11. The downhole swivel joint assembly as claimed in claim 10, wherein the bearing comprises a plurality of races.

12. The downhole swivel joint assembly as claimed in claim 10, wherein the bearing is located so as to be spaced from one of said components when said components are in the activated position.

13. The downhole swivel joint assembly as claimed in claim 12, wherein said spaced component is provided with means for engaging, when said components are in the activated configuration, co-operating means provided on the bearing so as to prevent relative rotation between the engaged part of said component and bearing.

14. The wellbore clean-up assembly comprising a downhole swivel joint assembly as claimed in claim 1 and further comprising a fluid circulating assembly, the fluid circulating assembly comprising a body incorporating a wall provided with at least one vent aperture extending therethrough; and a piston member slidably mounted in the body and slidable in the body in response to the application thereto of fluid pressure; wherein the piston member is slidable between a first position relative to the body, in which the or each vent aperture is closed, and a second position relative to the body, in which the or each vent aperture is open; the fluid circulating assembly further comprising constraining means adapted to prevent movement of the piston member from the first position to the second position; and overriding means for overriding the constraining means so as to permit movement of the piston to the second position.

15. The wellbore clean-up assembly as claimed in claim 14, wherein the piston is biased to the first position by means of a spring.

16. The wellbore clean-up assembly as claimed in claim 14, wherein the piston incorporates a wall provided with at least one opening extending therethrough such that, in the second position the openings of the piston and the body are in register, and in the first position the openings of the piston member and the body are out of register.

17. The wellbore clean-up assembly as claimed in claim 14, wherein the constraining means comprises a guide pin and a guide slot for receiving the guide pin.

18. The wellbore clean-up assembly as claimed in claim 17, wherein the guide slot extends in a direction having one component parallel to the direction of axial movement of the piston member.

19. The wellbore clean-up assembly as claimed in claim 17, wherein the overriding means comprises an extension of the guide slot.

20. The wellbore clean-up assembly as claimed in claim 17, wherein the guide pin is fixedly located relative to the body and the guide slot is formed in the exterior surface of the piston member or a second piston member slidably mounted in the body.

21. A method of cleaning a wellbore, the method comprising the steps of making up downhole apparatus comprising the wellbore clean-up assembly as claimed in claim 14; running said assembly down a wellbore to be cleaned; landing the downhole swivel joint on a restriction within the wellbore; applying weight of the downhole apparatus to said restriction so as to move the downhole swivel joint from an unactivated configuration to an activated configuration; moving the piston member of the fluid circulating assembly from the first position to the second position; and ejecting fluid from the interior of the fluid circulating assembly through the or each vent aperture.

22. The method of cleaning a wellbore as claimed in claim 21, further comprising the step of pumping cleaning fluid down the interior of the downhole apparatus and up the annulus between said apparatus and the wellbore prior to moving the piston member of the fluid circulating assembly.

23. The method of cleaning a wellbore as claimed in claim 21, further comprising the step of making up said downhole apparatus so that the fluid circulating assembly is located uphole of the downhole swivel joint assembly; and rotating the fluid circulating assembly within the wellbore once the swivel joint assembly has been activated.

24. A downhole swivel joint assembly comprising first and second components movable relative to one another in an axial direction along a longitudinal axis of the assembly, said components being movable relative to one another in said axial direction between a mechanically stable unactivated configuration in which relative rotational movement between the first and second components is prevented, and a mechanically stable activated configuration in which said rotational movement is permitted; wherein the assembly further comprises means for resisting movement of said components from the unactivated configuration to the activated configuration, said means comprising a resiliently deformable member arranged so as to be resiliently deformed when said components are moved from the mechanically stable unactivated configuration to the mechanically stable activated configuration, wherein said resiliently deformable member comprises a first cam surface and is retained in a fixed axial position relative to one of said first and second components, the other one of said components being provided with a second cam surface for co-operating with the first cam surface and radially camming said member in to a resiliently deformed position when moving from the unactivated configuration.

25. The downhole swivel joint assembly according to claim 24, wherein the resisting means resists movement of the components from the activated configuration to the unactivated configuration.

26. The downhole swivel joint assembly according to claim 25, wherein the resiliently deformable member is arranged to be resiliently deformed when the components are moved from the activated configuration to the unactivated configuration.

27. The downhole swivel joint assembly according to claim 24, wherein the force needed to move the components from the unactivated configuration to the activated configuration is greater than the force necessary to move the components from the activated configuration to the unactivated configuration.

28. The downhole swivel joint assembly according to claim 24, wherein said resiliently deformable member comprises a third cam surface, said other one of said components being provided with a fourth cam surface for co-operating with the third cam surface and radially camming said member in to a resiliently deformed position when moving from the activated configuration.

29. The downhole swivel joint assembly according to claim 24, wherein the first component is provided with means for connecting the assembly to further downhole equipment located, in use, above the assembly; and wherein the second component is provided with means for connecting the assembly to yet further downhole equipment located, in use, below the assembly.

30. The downhole swivel joint assembly according to claim 29, wherein the second component, or equipment connected thereto, is provided with an arm member extending outwardly for engaging, in use, with an uphole facing shoulder within a wellbore.

31. The downhole swivel joint assembly according to claim 24, wherein a bearing comprising rolling elements is provided between the first and second components so as to assist in relative rotation between said components when said components are in the activated configuration.

32. A downhole swivel joint assembly comprising first and second components movable relative to one another in an axial direction along a longitudinal axis of the assembly, said components being movable relative to one another in said axial direction between a mechanically stable unactivated configuration in which relative rotational movement between the first and second components is prevented, and a mechanically stable activated configuration in which said rotational movement is permitted; wherein the assembly further comprises means for resisting movement of said components from the unactivated configuration to the activated configuration, said means comprising a resiliently deformable member arranged so as to be resiliently deformed when said components are moved from the mechanically stable unactivated configuration to the mechanically stable activated configuration, wherein said resiliently deformable member comprises a cylindrical wall having a slot extending through the full thickness of the wall and along the full length of the cylindrical wall.

33. The downhole swivel joint assembly according to claim 32, wherein the resisting means resists movement of the components from the activated configuration to the unactivated configuration.

34. The downhole swivel joint assembly according to claim 33, wherein the resiliently deformable member is arranged to be resiliently deformed when the components are moved from the activated configuration to the unactivated configuration.

35. The downhole swivel joint assembly according to claim 32, wherein the force needed to move the components from the unactivated configuration to the activated configuration is greater than the force necessary to move the components from the activated configuration to the unactivated configuration.

36. The downhole swivel joint assembly according to claim 32, wherein the cylindrical wall is located about one of said first and second components.

37. The downhole swivel joint assembly according to claim 32, wherein the first component is provided with means for connecting the assembly to further downhole equipment located, in use, above the assembly; and wherein the second component is provided with means for connecting the assembly to yet further downhole equipment located, in use, below the assembly.

38. The downhole swivel joint assembly according to claim 37, wherein the second component, or equipment connected thereto, is provided with an arm member extending outwardly for engaging, in use, with an uphole facing shoulder within a wellbore.

39. The downhole swivel joint assembly according to claim 32, wherein a bearing comprising rolling elements is provided between the first and second components so as to assist in relative rotation between said components when said components are in the activated configuration.

40. A wellbore clean-up assembly comprising a downhole swivel joint assembly comprising first and second components movable relative to one another in an axial direction along a longitudinal axis of the assembly, said components being movable relative to one another in said axial direction between a mechanically stable unactivated configuration in which relative rotational movement between the first and second components is prevented, and a mechanically stable activated configuration in which said rotational movement is permitted; wherein the assembly further comprises means for resisting movement of said components from the unactivated configuration to the activated configuration, said means comprising a resiliently deformable member arranged so as to be resiliently deformed when said components are moved from the mechanically stable unactivated configuration to the mechanically stable activated configuration, and further comprising a fluid circulating assembly, the fluid circulating assembly comprising a body incorporating a wall provided with at least one vent aperture extending therethrough; and a piston member slidably mounted in the body and slidable in the body in response to the application thereto of fluid pressure; wherein the piston member is slidable between a first position relative to the body, in which the or each vent aperture is closed, and a second position relative to the body, in which the or each vent aperture is open; the fluid circulating assembly further comprising constraining means adapted to prevent movement of the piston member from the first position to the second position; and overriding means for overriding the constraining means so as to permit movement of the piston to the second position.

41. The wellbore clean-up assembly according to claim 40, wherein the piston is biased to the first position by means of a spring.

42. The wellbore clean-up assembly according to claim 40, wherein the piston incorporates a wall provided with at least one opening extending therethrough such that, in the second position the openings of the piston and the body are in register, and in the first position the openings of the piston member and the body are out of register.

43. The wellbore clean-up assembly according to claim 40, wherein the constraining means comprises a guide pin and a guide slot for receiving the guide pin.

44. The wellbore clean-up assembly according to claim 43, wherein the guide slot extends in a direction having one component parallel to the direction of axial movement of the piston member.

45. The wellbore clean-up assembly according to claim 43, wherein the overriding means comprises an extension of the guide slot.

46. The wellbore clean-up assembly according to claim 43, wherein the guide pin is fixedly located relative to the body and the guide slot is formed in the exterior surface of the piston member or a second piston member slidably mounted in the body.

47. A method of cleaning a wellbore, the method comprising the steps of making up downhole apparatus comprising the wellbore clean-up assembly according to claim 40, running said assembly down a wellbore to be cleaned; landing the downhole swivel joint on a restriction within the wellbore; applying weight of the downhole apparatus to said restriction so as to move the downhole swivel joint from an unactivated configuration to an activated configuration; moving the piston member of the fluid circulating assembly from the first position to the second position; and ejecting fluid from the interior of the fluid circulating assembly through the or each vent aperture.

48. The method of cleaning a wellbore according to claim 47, further comprising the step of pumping cleaning fluid down the interior of the downhole apparatus and up the annulus between said apparatus and the wellbore prior to moving the piston member of the fluid circulating assembly.

49. The method of cleaning a wellbore according to claim 47, further comprising the step of making up said downhole apparatus so that the fluid circulating assembly is located uphole of the downhole swivel joint assembly; and rotating the fluid circulating assembly within the wellbore once the swivel joint assembly has been activated.

* * * * *